US006738588B2

(12) United States Patent
Yokomori et al.

(10) Patent No.: US 6,738,588 B2
(45) Date of Patent: May 18, 2004

(54) IMAGE FORMING APPARATUS AND PROCESS CARTRIDGE DETACHABLY ATTACHABLE TO THE SAME

(75) Inventors: Kanji Yokomori, Kanagawa (JP); Tachio Kawai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/021,441

(22) Filed: Dec. 19, 2001

(65) Prior Publication Data

US 2002/0081126 A1 Jun. 27, 2002

(30) Foreign Application Priority Data

Dec. 21, 2000 (JP) ..... 2000-389627

(51) Int. Cl.[7] ..... G03G 21/16; G03G 21/00
(52) U.S. Cl. ..... 399/111; 399/128
(58) Field of Search ..... 399/118, 111, 399/112, 113, 177, 218, 221, 127, 128

(56) References Cited

U.S. PATENT DOCUMENTS

| | | | | |
|---|---|---|---|---|
| 5,839,028 | A | 11/1998 | Nomura et al. | 399/109 |
| 5,848,329 | A * | 12/1998 | Aoyama et al. | 399/113 |
| 5,850,585 | A | 12/1998 | Tsutsumi et al. | 399/128 |
| 5,878,309 | A | 3/1999 | Nomura et al. | 399/111 |
| 5,903,803 | A | 5/1999 | Kawai et al. | 399/116 |
| 5,940,657 | A | 8/1999 | Yokomori et al. | 399/119 |
| 5,943,528 | A | 8/1999 | Akutsu et al. | 399/110 |
| 5,950,049 | A | 9/1999 | Yokomori et al. | 399/119 |
| 5,953,562 | A | 9/1999 | Kawaguchi et al. | 399/117 |
| 6,029,031 | A | 2/2000 | Yokomori et al. | 399/109 |
| 6,055,406 | A | 4/2000 | Kawai et al. | 399/117 |
| 6,064,843 | A | 5/2000 | Isobe et al. | 399/111 |
| 6,072,969 | A | 6/2000 | Yokomori et al. | 399/119 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,173,150 | B1 * | 1/2001 | Suzuki et al. | |
| 6,175,706 | B1 | 1/2001 | Watanabe et al. | 399/167 |
| 6,215,969 | B1 | 4/2001 | Nomura et al. | 399/111 |
| 6,226,478 | B1 | 5/2001 | Watanabe et al. | 399/117 |
| 6,240,266 | B1 | 5/2001 | Watanabe et al. | 399/117 |
| 6,336,018 | B1 | 1/2002 | Kawai et al. | 399/117 |
| 6,345,164 | B1 | 2/2002 | Yokomori et al. | 399/119 |

FOREIGN PATENT DOCUMENTS

JP 10-123897 5/1998

* cited by examiner

*Primary Examiner*—Susan S. Y. Lee
(74) *Attorney, Agent, or Firm*—Fitzpatrick, Cella, Harper & Scinto

(57) ABSTRACT

A process cartridge which is detachably attachable to an image forming apparatus main body and which has a photosensitive drum is provided with a light guide. This light guide guides light from an LED lamp provided in the image forming apparatus main body to the surface of the photosensitive drum, thus forming a charge removing device for the photosensitive drum. Therefore, it is possible to provide an image forming apparatus and a process cartridge free from image problems, such as lateral stripes and a drum positive ghost, at a low cost.

51 Claims, 12 Drawing Sheets

IMAGE FORMING APPARATUS AND PROCESS CARTRIDGE DETACHABLY ATTACHABLE TO THE SAME

BACKGROUND OF THE INVENTION

1. Field of the Invention

The present invention relates to an electrophotographic type or electrostatic recording type image forming apparatus, such as a copying machine or a laser beam printer, and to a process cartridge to be used in such an image forming apparatus.

2. Description of the Related Art

In electrophotographic type and electrostatic type image forming apparatuses, a corona charger has conventionally been used as the charging means for the image bearing member consisting of an electrophotographic photosensitive member, electrostatic recording dielectric member or the like.

Recently, due to its advantages, such as low ozone and low power consumption characteristics, a contact charging device has been put into practical use, in which a charging member to which voltage is applied is brought into contact with the object to be charged, such as an image bearing member, to thereby charge the object to be charged. In particular, from the viewpoint of stabilization in charging, a roller charging type device using a conductive roller as the charging member is preferred.

In the roller charging type contact charging device, a conductive elastic roller serving as the charging member is brought into press contact with the object to be charged, and voltage is applied thereto to thereby charge the object to be charged.

More specifically, charging is effected through discharge from the charging member to the object to be charged, so that, by applying a voltage of not lower than a certain threshold value, charging is started.

For example, when an electrophotographic OPC photosensitive member having a thickness of 25 $\mu$m is used as the object to be charged and a charging roller is brought into press contact therewith to effect charging, application of a voltage of approximately 600 V to the charging roller causes the surface potential of the photosensitive member to start to rise. Thereafter, the surface potential of the photosensitive member increases and is linearly inclined with respect to the applied voltage.

In the following, this threshold voltage will be referred to as the charging start voltage Vth. To obtain the requisite photosensitive member surface potential VD for electrophotography, it is necessary to apply a DC voltage of a charging potential of Vth+VD to the charging roller.

This contact charging system, in which only DC voltage is applied to the contact charging member to thereby charge the object to be charged, will be referred to as the DC charging system.

This DC charging system involves, particularly in a low-humidity environment, image problems, such as "lateral stripes generated in halftone images, etc." mainly due to disturbance in the potential on the photosensitive drum (the photosensitive member) prior to charging, and what is called "a drum positive ghost" generated mainly due to a difference in the charging potential on the photosensitive drum in some cases.

As is known in the art, such image problems (lateral stripes generated in halftone images, etc., and a drum positive ghost) can be effectively prevented by providing a so-called charge removal means which irradiates the photosensitive drum with light before the charging process to thereby remove the residual charge.

As shown in FIG. 12, it has been general practice to provide the image forming apparatus main body with a charge removal means. For example, a charge removing device 302 (which consists of a chip array formed by arranging a plurality of LEDs 303, a fuse lamp or the like) is opposed to a photosensitive drum 1. FIG. 12 is a schematic perspective view of a charge removing device used in a conventional image forming apparatus.

However, this conventional construction, in which the charge removing device (a light source consisting of a chip array formed by arranging a plurality of LEDs, a fuse lamp or the like) is provided in the image forming apparatus main body so as to be opposed to the photosensitive drum, involves various problems. For example, the charge removing device is rather expensive, and the degree of freedom in the design of the image forming apparatus main body is restricted by the arrangement of the charge removing device.

In particular, in an image forming apparatus of the type in which a process cartridge is attached to and detached from the apparatus main body, consideration must be taken so that the location of the charge removing device may not interfere with the attachment/detachment of the process cartridge. Further, as a result of the attachment/detachment of the process cartridge, a problem is caused in that the positional accuracy of the charge removing device and the photosensitive drum deteriorates.

It might be possible to provide the charge removing device on the process cartridge side. However, that would inevitably make the process cartridge more expensive. Further, due to the provision of electrical contacts for connection with the image forming apparatus main body, the apparatus would become rather complicated and more expensive.

SUMMARY OF THE INVENTION

It is an object of the present invention to provide an image forming apparatus and a process cartridge capable of preventing image problems, such as lateral stripes generated in halftone images and drum positive ghost, without involving a complicated structure of the apparatus, an increase in cost, or restriction in design.

Another object of the present invention is to provide an image forming apparatus and a process cartridge having an image bearing member, and a light guide means for guiding light, wherein the light guide means has a reflection means for reflecting light to the image bearing member side.

Still another object of the present invention is to provide an image forming apparatus and a process cartridge having an image bearing member, and a light guide means for guiding light, wherein the light guide means changes the direction of light from the light source to the image bearing member.

Further objects of the present invention will become apparent from the following description.

DETAILED DESCRIPTION OF THE PREFERRED EMBODIMENTS

Embodiments of the present invention will now be described with reference to the drawings.

(First Embodiment)

Figure 1:
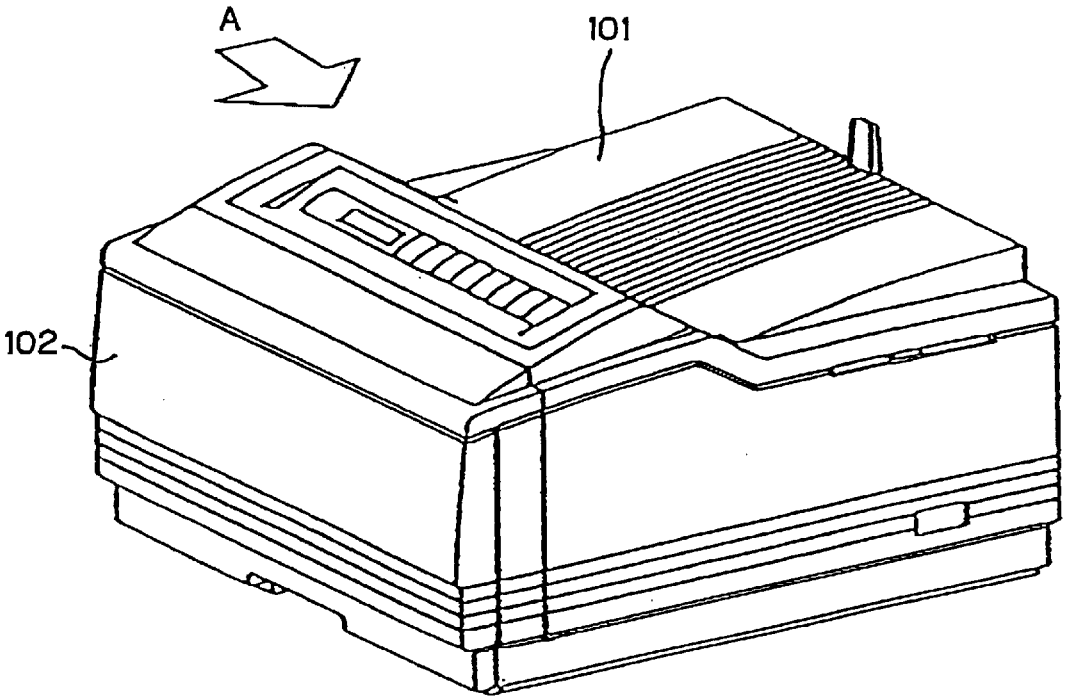
FIG. 1 is an external perspective view of an image forming apparatus in accordance with an embodiment of the present invention.

First, an image forming apparatus and a process cartridge according to the present invention will be described. FIG. 1 is an external perspective view of an image forming apparatus (laser beam printer) in accordance with an embodiment of the present invention, and FIG. 2 is an external perspective view of a process cartridge 103 which can be attached to and detached from the image forming apparatus main body 101 by opening a front cover 102 of the image forming apparatus main body 101 shown in FIG. 1.

The process cartridge 103 contains a photosensitive drum serving as an image bearing member, a charging means for uniformly charging the image bearing member, a developing means for developing a latent image formed on the image bearing member, and a cleaning means for removing any residue on the image bearing member.

Thus, the process cartridge has the image bearing member (photosensitive drum) rotatable around a central axis, and at least one of the following components of the charging means, the developing means, and the cleaning means, and is detachably attachable to the image forming apparatus main body.

Figure 2:
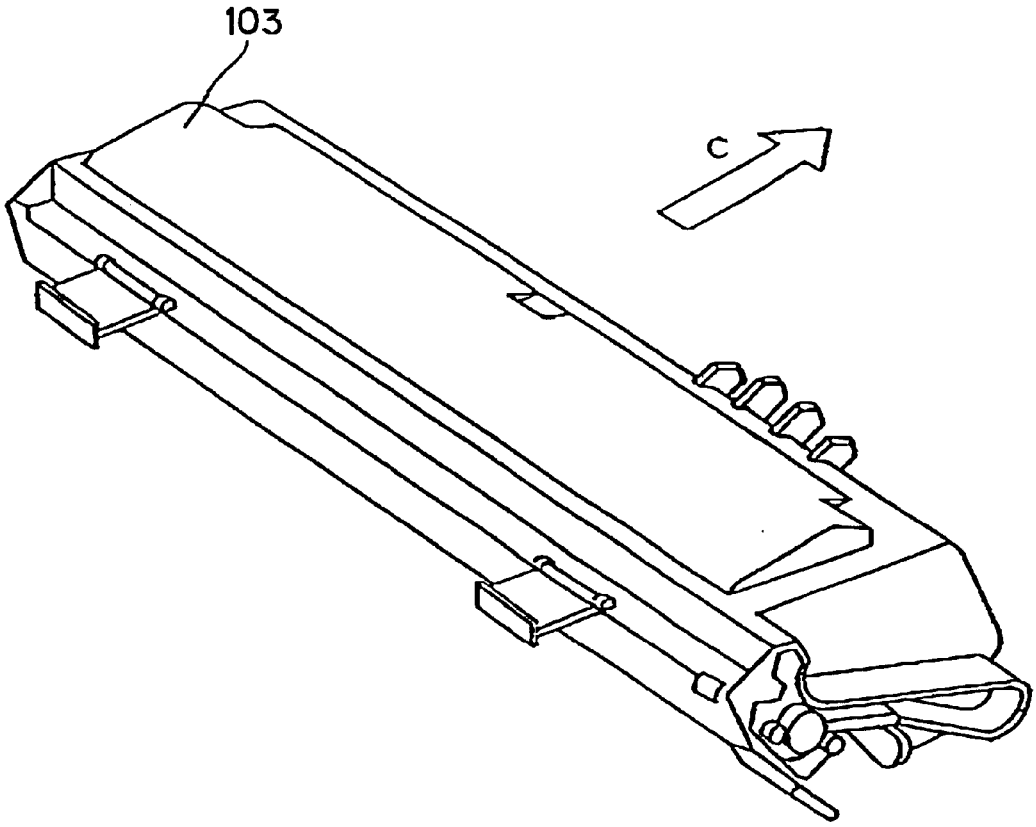
FIG. 2 is an external perspective view of a process cartridge which is detachably attachable to the main body of the image forming apparatus shown in FIG. 1.
Figure 3:
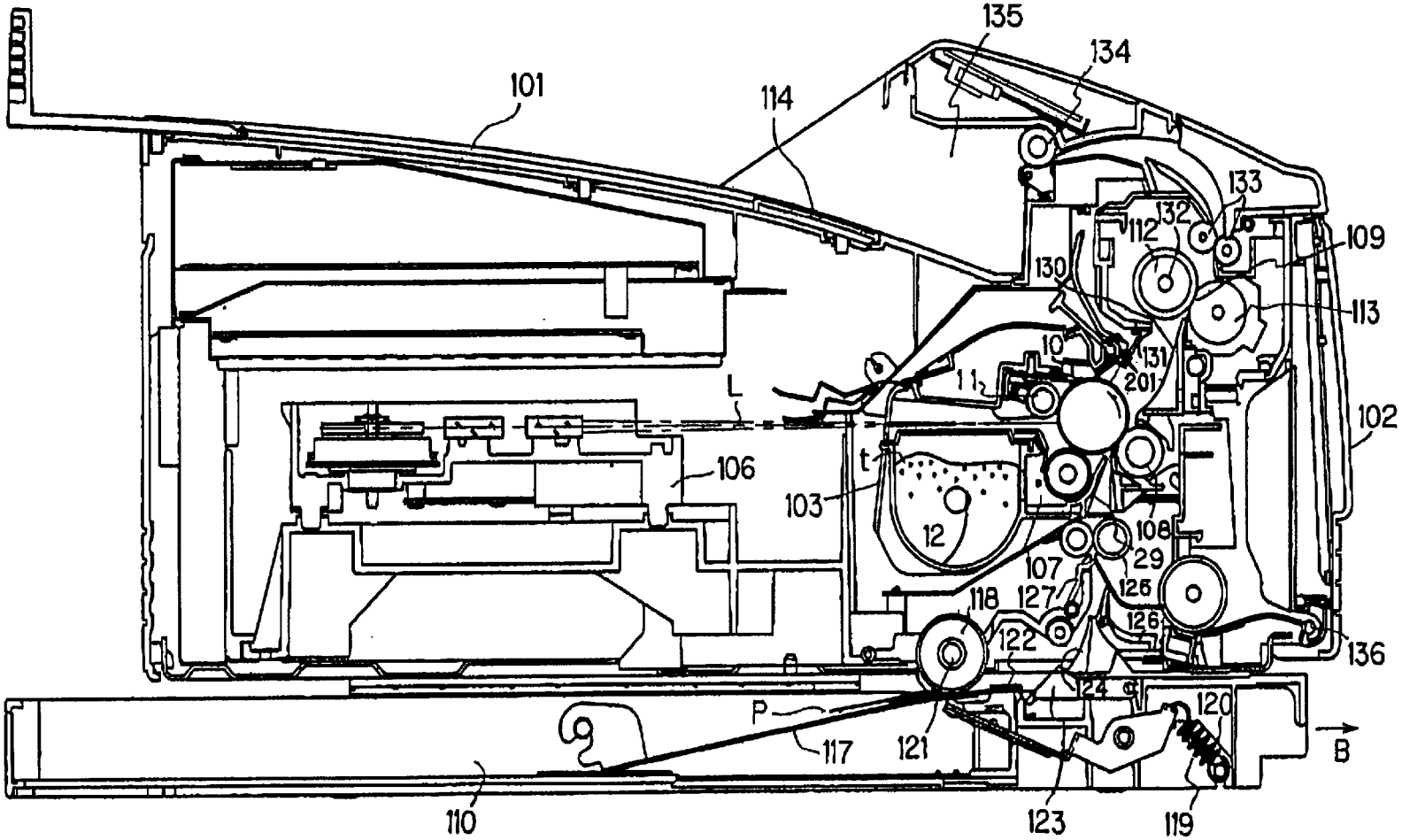
FIG. 3 is a diagram showing the construction of the image forming apparatus.
Figure 4:
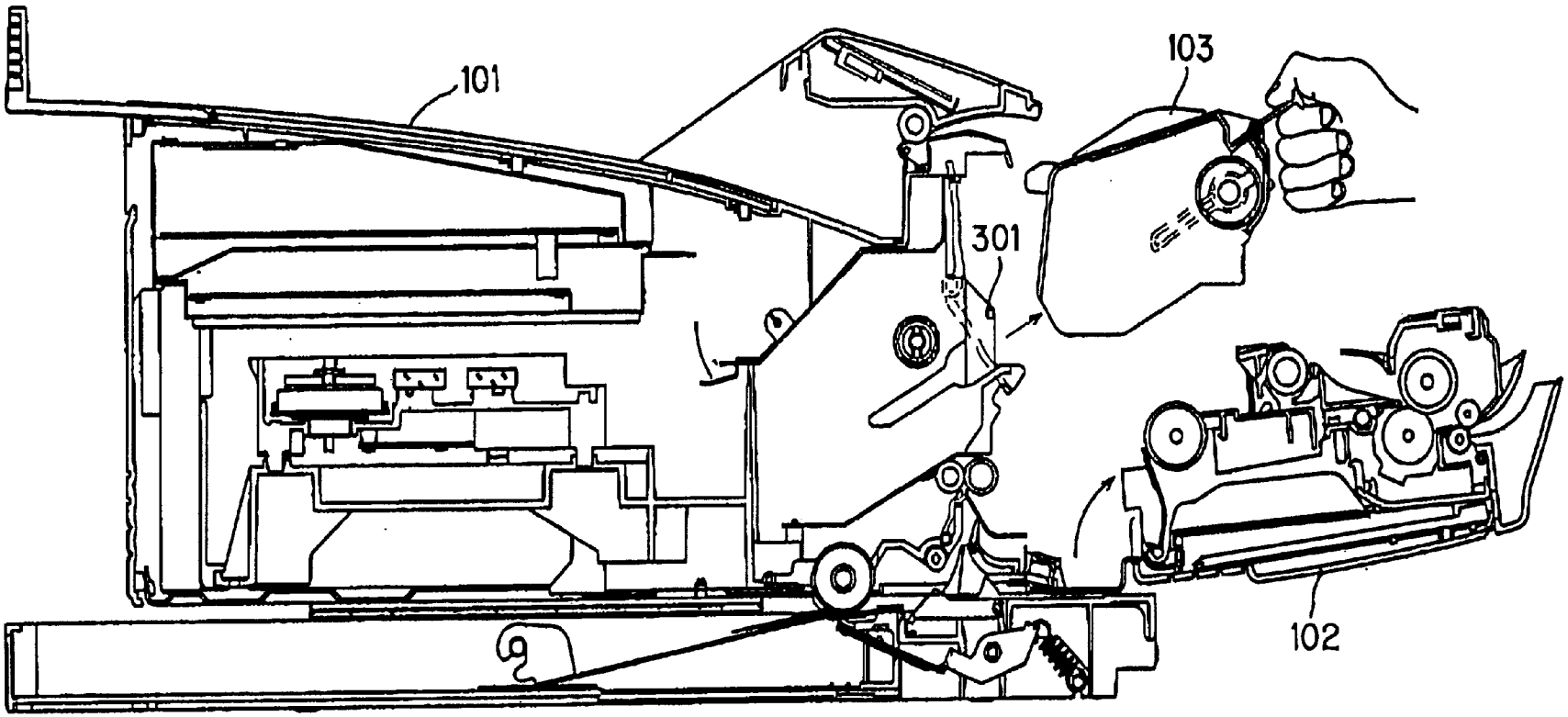
FIG. 4 is a diagram showing how the process cartridge is attached to or detached from the image forming apparatus main body.

FIG. 3 is a sectional view (as seen from the direction A of FIG. 1) of the image forming apparatus main body 101 with the process cartridge 103 shown in FIG. 2 attached thereto. FIG. 4 is a sectional view showing how the front cover 102 shown in FIG. 1 is opened and the process cartridge 103 is attached/detached in the direction C of FIG. 2.

First, the image forming process of the image forming apparatus will be schematically described with reference to FIG. 3. The photosensitive drum 1 serving as the image bearing member in the present invention has a photosensitive layer on its surface, which is uniformly charged by a charging roller 11.

Next, a laser beam L is applied from a laser optical unit 106 onto the photosensitive drum 1 according to image information input from an external computer or the like.

As a result, an electrostatic latent image in conformity with the image information is formed on the photosensitive drum 1. Next, with a developing portion 107, the portion of the photosensitive drum 1 to which the laser beam L is applied is developed with toner t of the same polarity as the charge on the photosensitive member, whereby a visible image is formed on the photosensitive drum 1.

Next, the visible image reaches a transfer position defined by the photosensitive drum 1 and a transfer roller 108, and, in synchronism with this, a recording material P supplied from a sheet feeding cassette 110 is caught between the photosensitive drum 1 and the transfer roller 108, and the visible image is transferred to the recording material P.

Then, this recording material P is caught by a fixing portion (fixing nip portion) 109 defined by a fixing roller 112 and a pressure roller 113, and the visible image is fixed to the recording material P. Thereafter, the recording material P is discharged onto a discharge tray 114.

After the transfer, the residue on the photosensitive drum 1, such as the residual toner, is removed by a cleaning device 10, and the charging process is repeated.

Next, the process for conveying the recording material P will be described in detail. A plurality of recording materials P are stacked in the sheet feeding cassette 110, and the leading end of each recording material P is pressed against the surface of a sheet feeding roller 118 by a loading plate 117 to which a force is applied by an extension spring and which is adapted to swing. When the user loads recording materials P into this apparatus, the sheet feeding cassette 110 is pulled out to the right as seen in the drawing (in the direction of the arrow B).

At this time, a sheet feeding spring support shaft 119 moves upwards along slide grooves 120 formed in the two side walls (one of which is shown in the back of the drawing and the other of which is omitted in front of it) of the sheet feeding cassette 110, and the loading plate 117 is lowered to the bottom of the sheet feeding cassette 110, so that the loading of the recording materials P can be smoothly effected.

The sheet feeding roller 118 is secured to a sheet feeding drive shaft 121, and a clutch and a solenoid (not shown) are provided at a shaft end of the sheet feeding drive shaft 121, making it possible to control the rotation of the sheet feeding roller 118.

Separation claws 122 are provided at the right and left corners of the leading end portion of the recording material on the sheet feeding roller side, and, in the vicinity of the forward end thereof, there is swingably provided a cassette inlet guide 123 to which a force is applied by a spring (not shown).

Further, a guide portion 124 for guiding the recording material from the sheet feeding cassette 110 is formed in the apparatus main body, guiding the recording material P to a registration roller pair 125.

When the solenoid (not shown) is turned ON by a sheet feeding start signal, the driving force of a sheet feeding drive gear (not shown) is transmitted to the drive shaft 121 through the clutch (not shown), and the sheet feeding roller 118 rotates to guide the recording material P to the cassette inlet guide 123.

At this time, the coefficient of friction is such that only the uppermost recording material is led out. Soon after this, the recording material P reaches the nip portion of the registration roller pair 125 by the rotation of the sheet feeding roller 118.

The apparatus main body has a second inlet 126 for feeding a recording material P other than those in the sheet feeding cassette 110 to the registration roller pair 125.

Due to this construction, it is possible to introduce recording materials P into the apparatus main body from other feeding means, such as a sheet deck or an optional cassette provided in the lower portion of the apparatus main body, thus realizing a construction superior in expandability.

A sensor lever 127 is provided on the upstream side of the registration roller pair 125 with respect to the recording material, conveying direction.

The sensor lever 127 is axially supported, being capable of swinging on the frame of the apparatus main body, and the leading end of the recording material P is detected with a photo interrupter (not shown) or the like for sensing the motion of the sensor lever 127.

After the detection of the position of the leading end of the recording material P, the recording material P is conveyed by the registration roller pair 125 to the gap between the photosensitive drum 1 and the transfer roller 108 in synchronism with the leading end of the visible image on the photosensitive drum 1.

A plurality of guide ribs 29 serving as guide members are formed on the surface of a part of a developer container 12 of a developing portion 107. The plurality of guide ribs 29 are arranged side by side in the longitudinal direction of the developer container 12. During conveyance, the guide ribs 29 are used as guide members for the recording material, whereby conveyance can be effected with high accuracy with respect to the photosensitive drum 1.

Thereafter, the toner image formed on the photosensitive drum 1 by an image forming process described below is transferred to the recording material P by the transfer roller 108 pressed against the photosensitive drum 1 with a predetermined pressure.

In this process, a bias is applied to the transfer roller 108 and toner is electrostatically attracted by the surface of the recording material P.

As an auxiliary means for separating the recording material P from the photosensitive drum 1 after the transfer, a charge removal needle (not shown) is embedded in the forward end portion on the upstream side of a fixing inlet guide 130, making it possible to smoothly separate the kind of recording material difficult to separate.

This makes it possible to prevent the recording material P from winding itself around the photosensitive drum 1 due to inadequate separation of the recording material.

Further, an intrusion preventing guide 131 is arranged on a surface opposed to the fixing inlet guide 130, so that, if there should occur inadequate separation of the recording material, it is possible to avoid serious jamming.

The recording material P which has undergone image transfer is guided to a fixing portion 109 by the fixing inlet guide 130.

In the fixing portion 109, there is provided a fixing roller 112 containing a halogen heater 132 therein as a heat source. A pressure roller 113 is pressed against the fixing roller with a predetermined pressure. A drive gear (not shown) rotates the fixing roller 112 or the pressure roller 113.

The temperature of the fixing roller 112 is detected by a thermistor (not shown) in contact with the surface of the fixing roller 112, and is controlled by a controller in an electrical equipment portion (not shown) of the apparatus main body.

Further, as a runaway protection for the halogen heater 132, there is arranged a non-contact thermoswitch (not shown) above the fixing roller 112.

The recording material P passes through the fixing portion between the heated fixing roller 112 and the pressure roller 113, whereby the toner image on the recording material P is permanently fixed to the recording material P.

After the fixing, the recording material P is separated from the surface of the fixing roller 112 by a separation claw (not shown), and is then conveyed upwards by a pulling roller pair 133 arranged above the fixing roller 112.

The pulling roller pair 133 is rotated at a relative velocity higher than that of the fixing roller 112 by several %, so that the recording material P is forcibly kept tense while being conveyed, whereby the recording material is prevented from being curled, wrinkled, etc.

Thereafter, the recording material P is discharged to the exterior of the apparatus by a discharge roller 134, and placed on a discharge tray 114 provided in a discharge outlet 135.

The transfer roller, the fixing portion, the pulling roller, etc. mentioned above are integrally secured to the front cover 102, which is rotatably supported by a shaft 136 of the apparatus main body. That is, as shown in FIG. 4, the front cover 102 can be dislocated, allowing opening and closing with respect to the apparatus main body.

Figure 5:
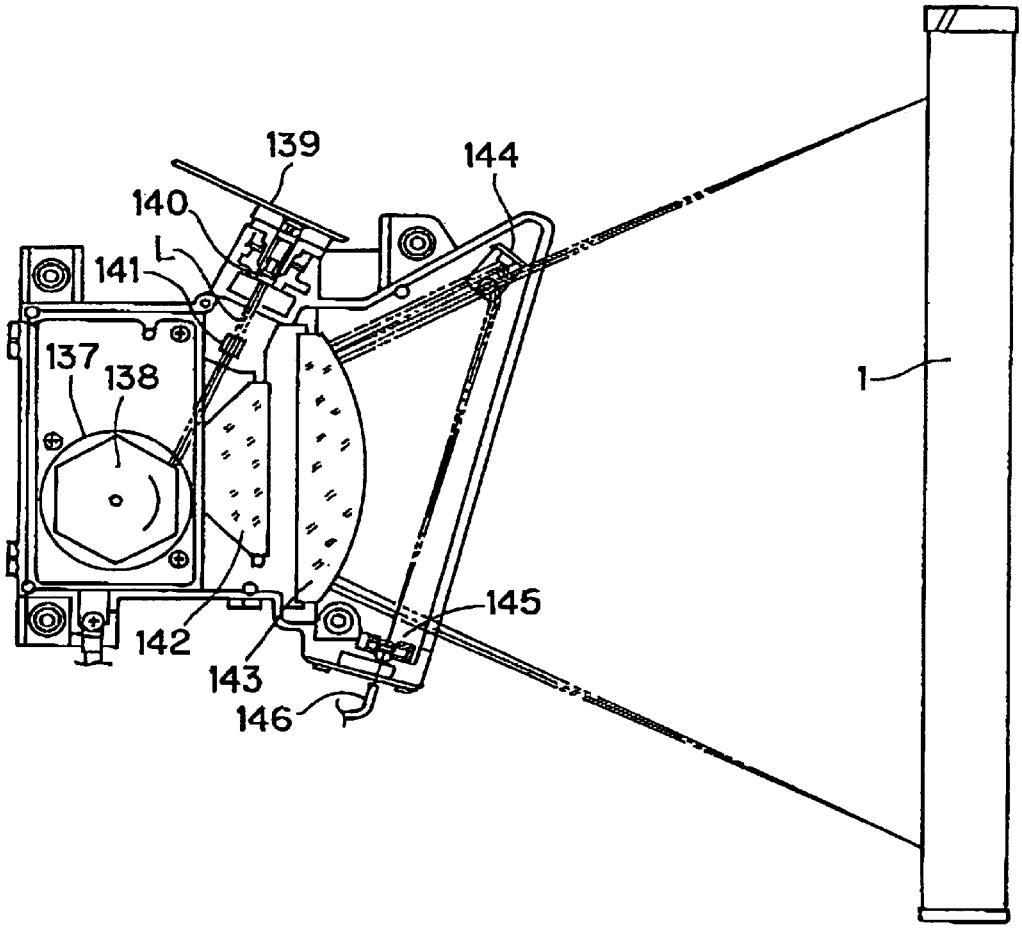
FIG. 5 is a schematic diagram showing the construction of a laser optical system.

Next, the laser optical system of the image forming portion will be described with reference to FIGS. 3 and 5. FIG. 5 is a schematic diagram showing the laser optical system provided in the image forming apparatus shown in FIG. 1.

As shown in FIG. 5, a rotary polygon mirror 138 is secured to the rotation shaft of a polygon motor 137 running at high speed.

Then, a laser beam L emitted from a laser unit 139 is passed through a collimator lens 140 and a cylindrical lens 141, and then reflected by the surface of the polygon mirror 138. Then, the laser beam is converged on the photosensitive drum 1 through a spherical lens 142 and an Fθ lens 143.

By rotating the polygon mirror 138, the laser beam L scans the photosensitive drum 1 in the generatrix direction thereof, and by turning ON and OFF the laser unit 139, the electric potential of the point where the laser beam L, is applied is adjusted to a predetermined level, thereby forming an electrostatic latent image on the photosensitive drum.

At this time, to obtain a reference for the laser scanning (referred to as the main scanning) in the generatrix direction of the photosensitive drum 1 by the polygon mirror 138, a BD mirror 144 is provided at a position where the main scanning is started and which is located outside of the image area.

After being reflected by the BD mirror 144, the laser beam L is received by a laser receiving surface 145 provided at a position substantially equal to the surface of the photosensitive drum 1. Thereafter, the laser beam L is introduced to a laser photoreceptor (not shown) on a DC controller (not shown) by an optical fiber 146 in the laser receiving surface 145.

In this construction, the reference timing for the laser scanning is obtained through beam detection from the image output timing. An image signal is output to the laser unit according to clock-pulses based on the reference timing, whereby the main scanning is effected.

The above-mentioned optical components, such as the polygon mirror, mirrors, and lenses, are integrally accommodated in a laser optical unit 106, which is secured in the apparatus main body with high-accuracy positioning.

Next, the process cartridge 103 provided in the image forming apparatus shown in FIG. 1 will be described with reference to FIG. 6, which is a schematic diagram showing the construction of the process cartridge 103 provided in the image forming apparatus shown in FIG. 1.

In the process cartridge, the photosensitive drum 1 rotating around a central axis, the charging roller 11, the developing device 2, the cleaning device 10, and the light guide 201 serving as the light guide means of the present invention (described in detail below) are integrated into a unit.

These components are mounted in the process cartridge in a predetermined positional interrelationship. That is, the photosensitive drum 1 and the light guide 201 are secured in position in the process cartridge while maintaining a predetermined positional relationship. The process cartridge can be inserted and attached in a predetermined manner to a predetermined portion in the image forming apparatus main body, and can be detached from the apparatus main body. The attachment and detachment of the process cartridge is effected in a direction substantially perpendicular to the axial direction of the photosensitive drum.

When the image forming apparatus is used for a long period of time, the components, such as the photosensitive drum, the charging device, the developing device, and the cleaning device are worn out, resulting in deterioration in the printing quality. Then, the user replaces the process cartridge 103 with a new one, thus sparing the user the trouble of maintenance.

Figure 6:
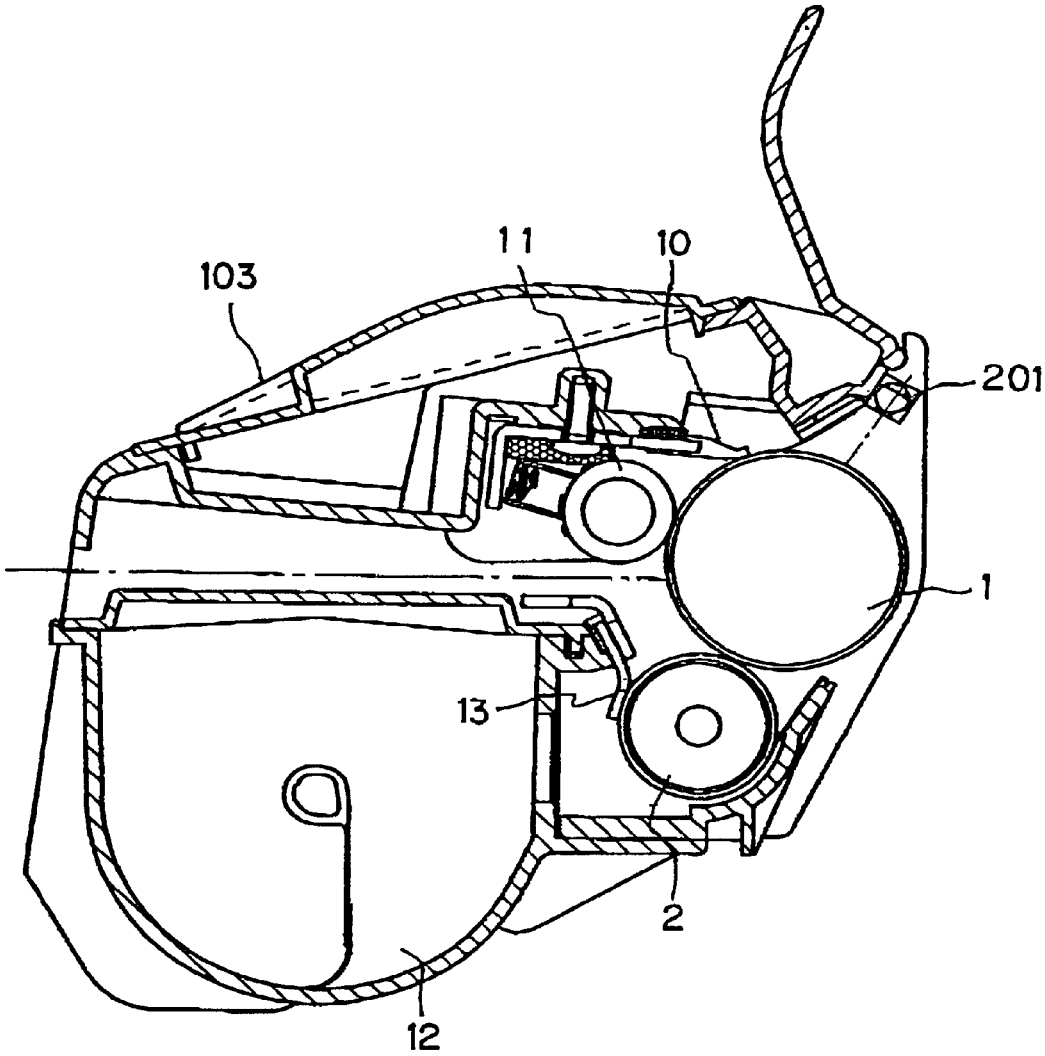
FIG. 6 is a schematic diagram showing the construction of the process cartridge.
Figure 7:
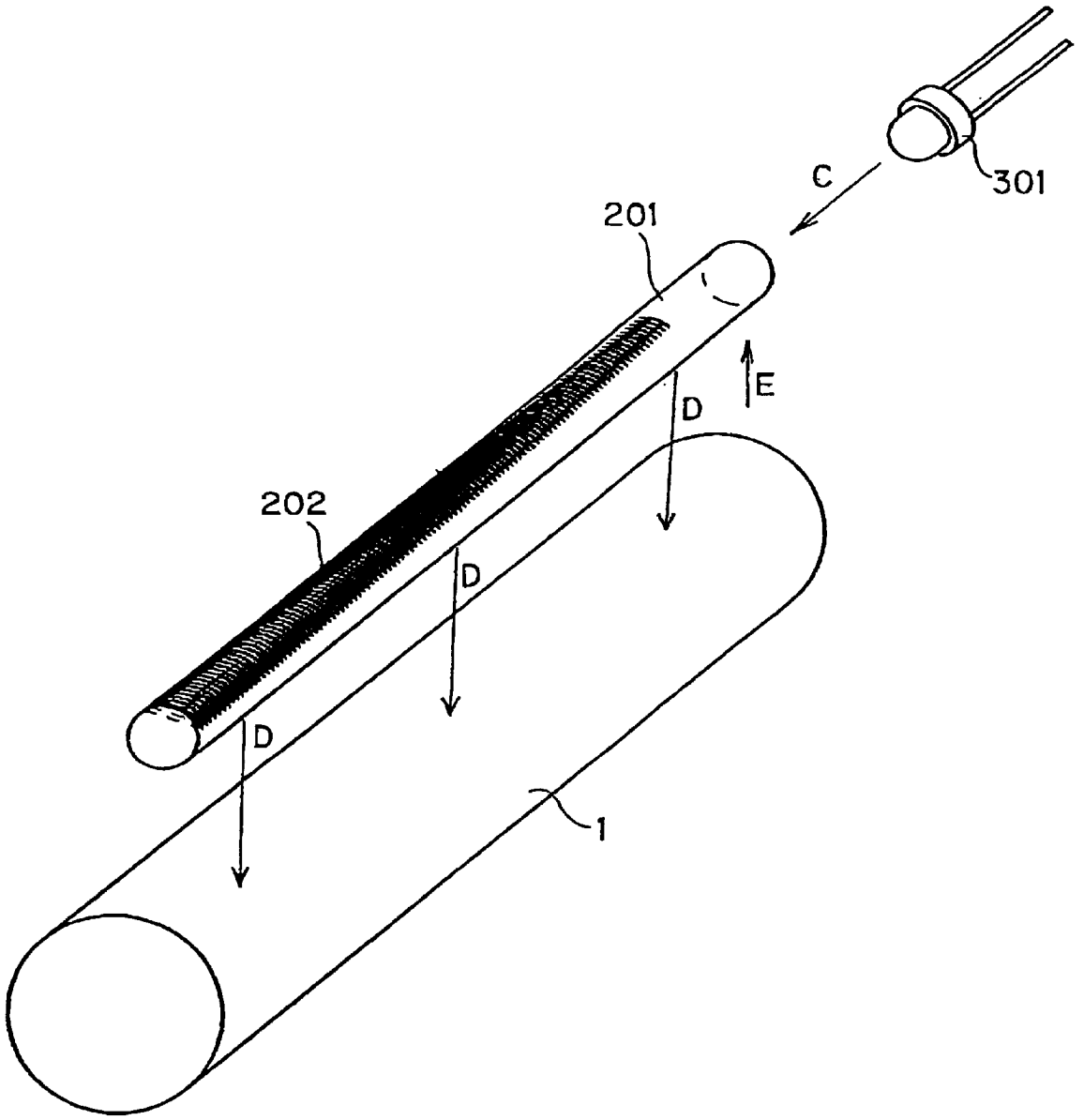
FIG. 7 is a schematic diagram showing a charge removing device.

Next, the operation of the light guide 201 shown in FIG. 6 will be described with reference to FIG. 7, which is a schematic diagram showing how the light guide 201 shown in FIG. 6 is used as a charge removing device. It is to be noted that FIG. 7 exclusively shows the photosensitive drum and the charge removing device, with the other components being omitted. The charge removing device performs exposure on the photosensitive drum 1 after the transfer by the transfer means 108 and before the charging by the charging means 11.

Roughly speaking, the charge removing device of the present invention comprises the following two components.

(1) Light emission source: "LED lamp" 301 provided in the image forming apparatus main body; and (2) Light application member: "bar-shaped light guide" 201 provided in the process cartridge.

The LED lamp 301 and the bar-shaped light guide 201 will be described in detail.

First, the LED lamp 301, which is a light source, serves as the exposure means for the photosensitive drum and is provided on a side plate in the image forming apparatus main body (see FIG. 4). It is arranged longitudinally outside the charge removal width (area) on the photosensitive drum 1. That is, the LED lamp 301 is provided outside the process cartridge with respect to the axial direction of the photosensitive drum and on the apparatus main body side.

Then, the LED lamp 301 performs exposure on the light guide 201 from a direction parallel to the longitudinal direction of the light guide 201 (or the photosensitive drum 1) (i.e., the axial direction of the photosensitive drum).

Further, light shielding is effected so that the light from the LED lamp 301 may not be unnecessarily applied to the end portions of the photosensitive drum 1.

Next, the material, configuration, function, and arrangement of the bar-shaped light guide 201 will be described.

Figure 8:
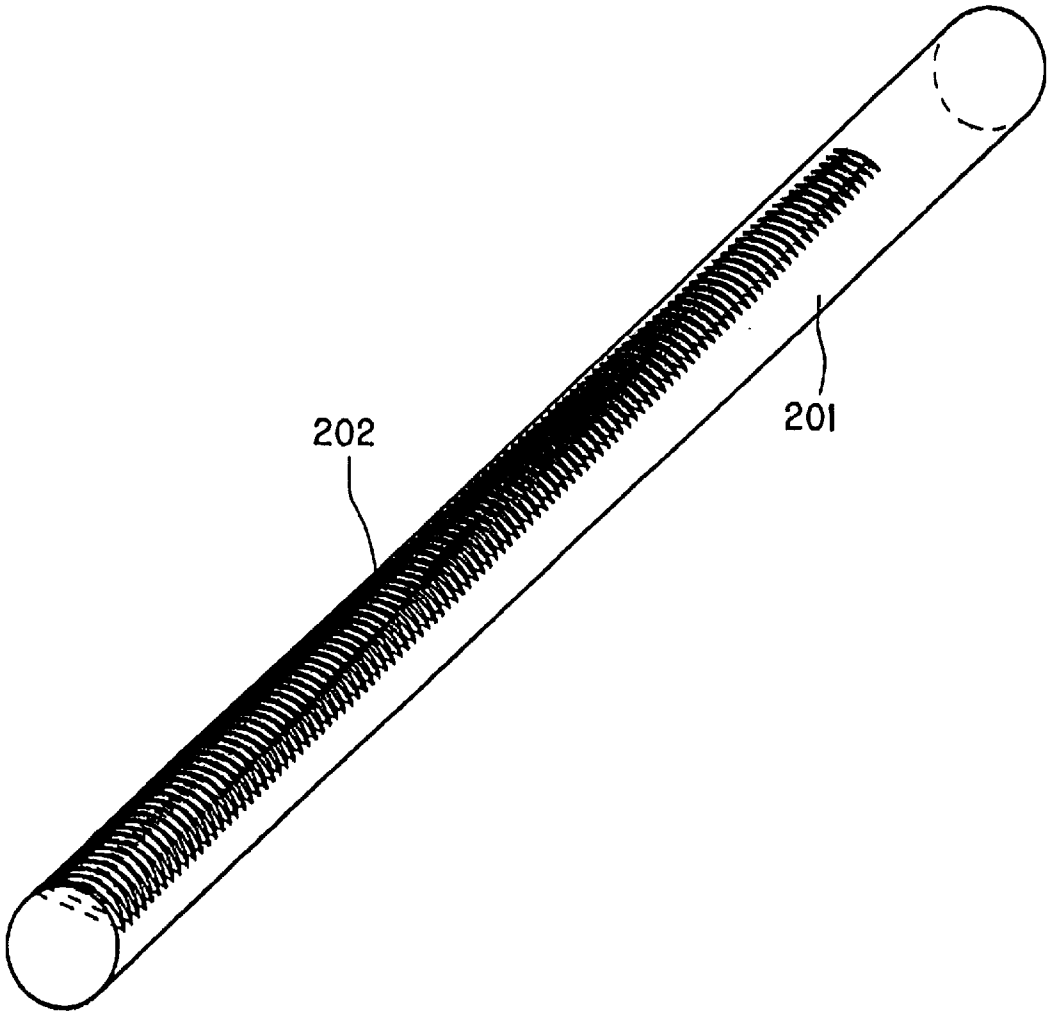
FIG. 8 is a schematic diagram showing a light guide.

As the material for the light guide 201, a resin superior in light transmittance (such as acrylic resin, polycarbonate, or polystyrene), glass or the like is used. FIG. 8 shows the configuration of the light guide. FIG. 8 is a diagram showing the construction of the light guide 201 shown in FIG. 7.

The light guide 201 is opposed to the photosensitive drum 1, and has on its surface farther from the photosensitive drum 1 a reflection means having a plurality of reflecting portions. In this embodiment, the reflecting portions consist of protrusions and recesses defined by V-shaped notches 202. A plurality of notches 202 are arranged side by side in the longitudinal direction of the light guide 201. Of course, the number of notches 202 may be arbitrary, and it may be one.

Here, a construction is adopted in which light is reflected by utilizing a variation in the refractive index of the light guide 201 due to protrusions and recesses, which consist of cutouts, dents, projections, etc. formed on the surface of the light guide means.

The configuration of the protrusions and recesses is not restricted to a V-shaped. Other configurations, such as a U-shape and an I-shape, may also be adopted.

Then, due to the V-shaped notches 202, light applied from an end portion of the light guide 201 in the direction of the arrow C (FIG. 7) is reflected perpendicularly to the longitudinal direction of the light guide (as indicated by the arrows D), thereby making it possible to irradiate the photosensitive drum 1 with light.

This light is applied to the surface of the photosensitive drum 1 as "charge removal light" in a predetermined charge removal width (exposure width).

Further, the farther the V-shaped notch 202 is from the LED lamp, the larger is the depth and width thereof, whereby the charge removal light is applied to the surface of the photosensitive drum 1 in a light quantity uniform in the longitudinal direction.

That is, the size of the V-shaped notch 202 gradually increases according to its longitudinal position on the light guide 201, i.e., the larger the distance from the exposure point of the LED lamp (the point where the light from the LED lamp enters the light guide 201), the larger the size of the V-shaped notch 202.

In this embodiment, the light guide 201 extends in the longitudinal direction (the axial direction) of the photosensitive drum 1 and is opposed thereto and spaced apart therefrom by 4 mm so that charge removal may be effected on the photosensitive drum 1 after the transfer process. The longitudinal direction of the light guide is substantially the same as the axial direction of the photosensitive drum.

Figure 9:
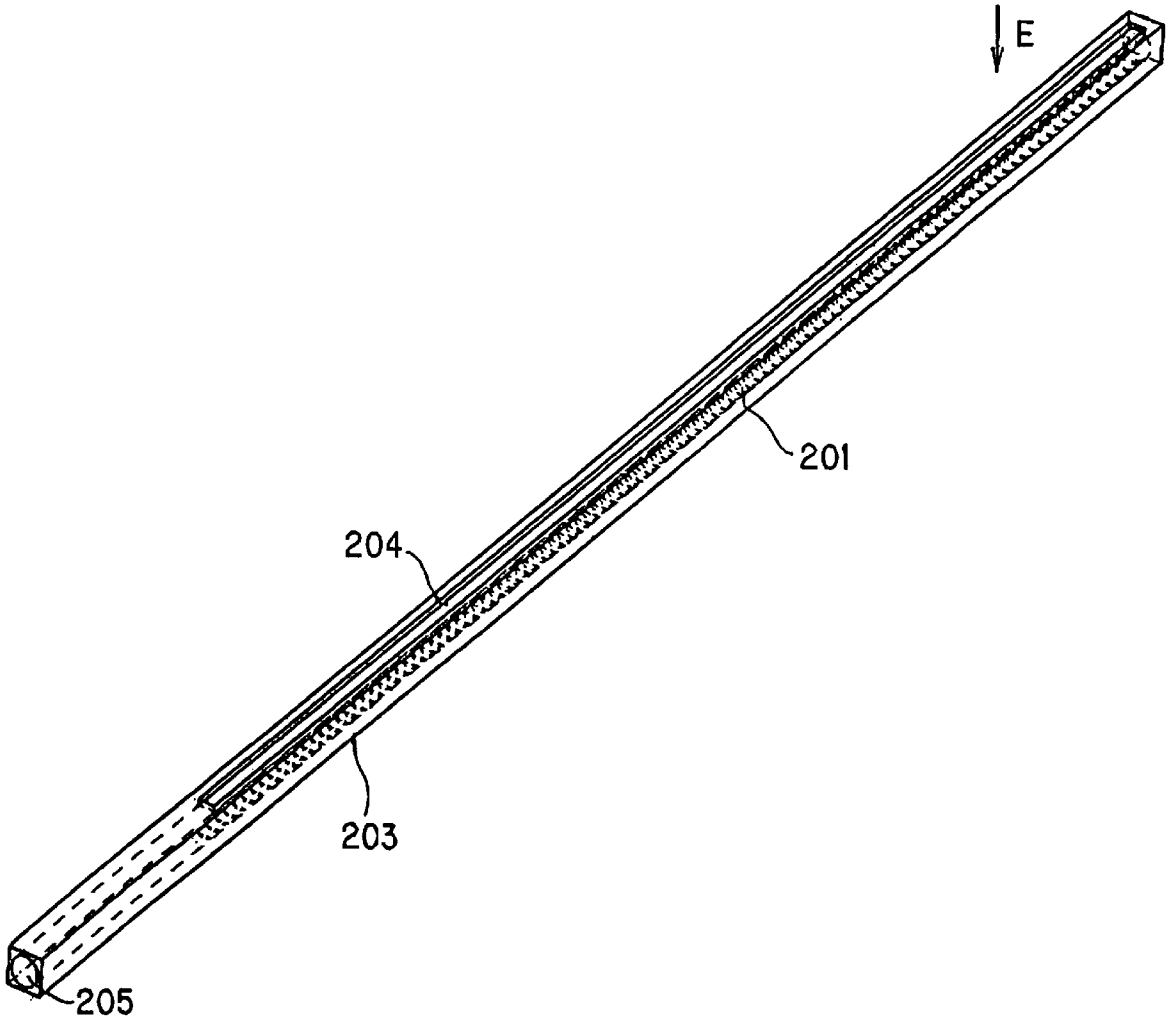
FIG. 9 is a diagram showing the light guide as covered.

Next, the light guide 201 shown in FIG. 8 will be further described with reference to FIGS. 9 and 10. FIG. 9 is a schematic view of the light guide 201 shown in FIG. 8 as seen from the direction of the arrow E of FIG. 7, and FIG. 10 is a diagram showing the light guide 201 of FIG. 9 as attached to the process cartridge.

As shown in FIG. 9, to enhance its reflection efficiency, the light guide 201 is covered with a white resin case 203 serving as a cover. This effect can be achieved as long as at least the inner surface of the resin case 203 covering the light guide 201 is white.

The resin case 203 has a first opening 205 through which the light from the LED lamp 301 is passed for the irradiation, and a second, predetermined opening 204 which is opposed to the photosensitive drum 1 and which makes it possible to irradiate the photosensitive drum 1 with light.

Figure 10:
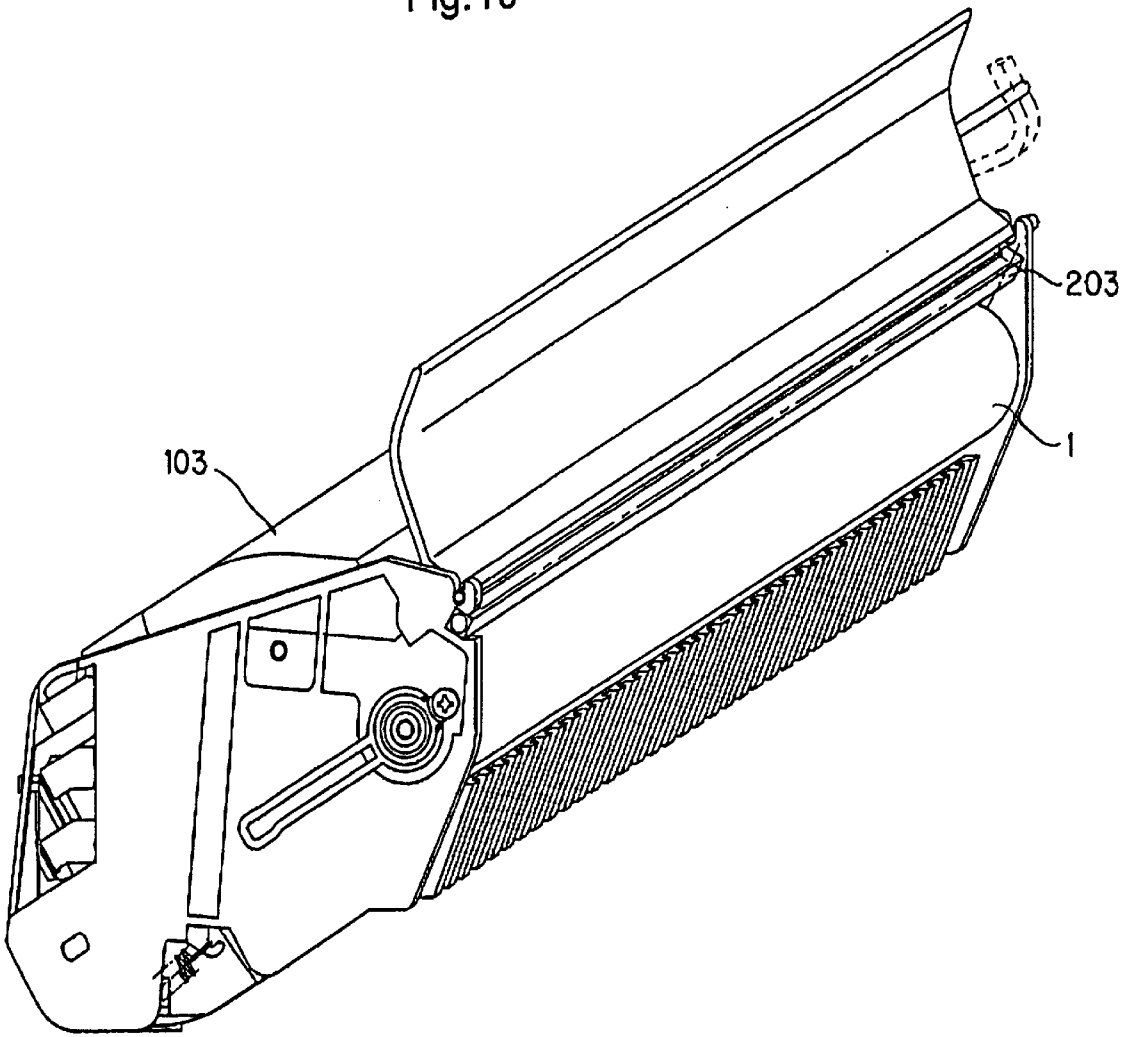
FIG. 10 is a diagram showing the process cartridge with the light guide attached thereto.

Then, as shown in FIG. 10, this resin case 203 is mounted to a predetermined position on the process cartridge 103.

Thus, only when the process cartridge 103 is attached to the image forming apparatus main body 101, the light from the LED lamp 301 provided in the image forming apparatus main body and serving as the light source is allowed to enter the end portion of the light guide 201 serving as the light application member provided in the process cartridge 103, and, after being reflected by the light guide 201, is applied to the photosensitive drum 1 as charge removal light.

When, as in this embodiment, a light guide type member is used as the light application member for applying light to the photosensitive drum, the ripple in light quantity on the photosensitive drum is relatively small as compared, for example, with the case of a chip array type device in which a plurality of LEDs are arranged. Thus, it is possible to uniformly remove charge.

Further, in this embodiment, the LED lamp 301 is provided in the apparatus main body, at a position outside the process cartridge 103 with respect to the axial direction of the photosensitive drum 1, so that the LED lamp 301 constitutes no obstruction to attachment/detachment of the process cartridge 103 in the direction perpendicular to the axial direction of the photosensitive drum 1. Further, in this case, the LED lamp 301 emits light in the longitudinal direction of the light guide 201 to cause it enter the light guide 201, which means the LED lamp 301 is originally arranged outside the process cartridge 103 with respect to the axial direction of the photosensitive drum 1, and there is no particular limitation regarding its arrangement.

Further, in this embodiment, the photosensitive drum 1 and the light guide 201 are provided integrally in the process cartridge 103, so that no change is caused in their positional relationship through attachment and detachment of the process cartridge 103, making it possible to perform exposure on the photosensitive drum 1 with the light guide 201 with high accuracy.

Furthermore, in this embodiment, the LED lamp 301 serving as the light source is provided on the apparatus main body side, so that the light source is not wastefully thrown away upon the exchange of the process cartridge 103, thereby achieving a reduction in the process cartridge cost. Further, the electrical connection between the image forming apparatus main body and the process cartridge can be simplified.

While in the first embodiment, a single LED lamp 301 is provided so as to be opposed to one end surface with respect to the longitudinal direction of the light guide 201, it is also possible, if there is a deficiency of light quantity, to add an LED lamp so as to be opposed to either end surface of the light guide, that is two LED lamps in total. In this case, the depth (size) of the central notch of the light guide is a maximum so that the distribution of light quantity in the charge removal width range on the photosensitive drum may be uniform.

By providing a charge removing device according to the first embodiment as described above, it is possible to prevent the occurrence of image problems, such as lateral stripes in a halftone image and a drum positive ghost or the like, at a relatively low cost and without impairing the degree of freedom in the design of the image forming apparatus main body, thus making is possible to obtain a satisfactory image.

(Second Embodiment)

Figure 11:
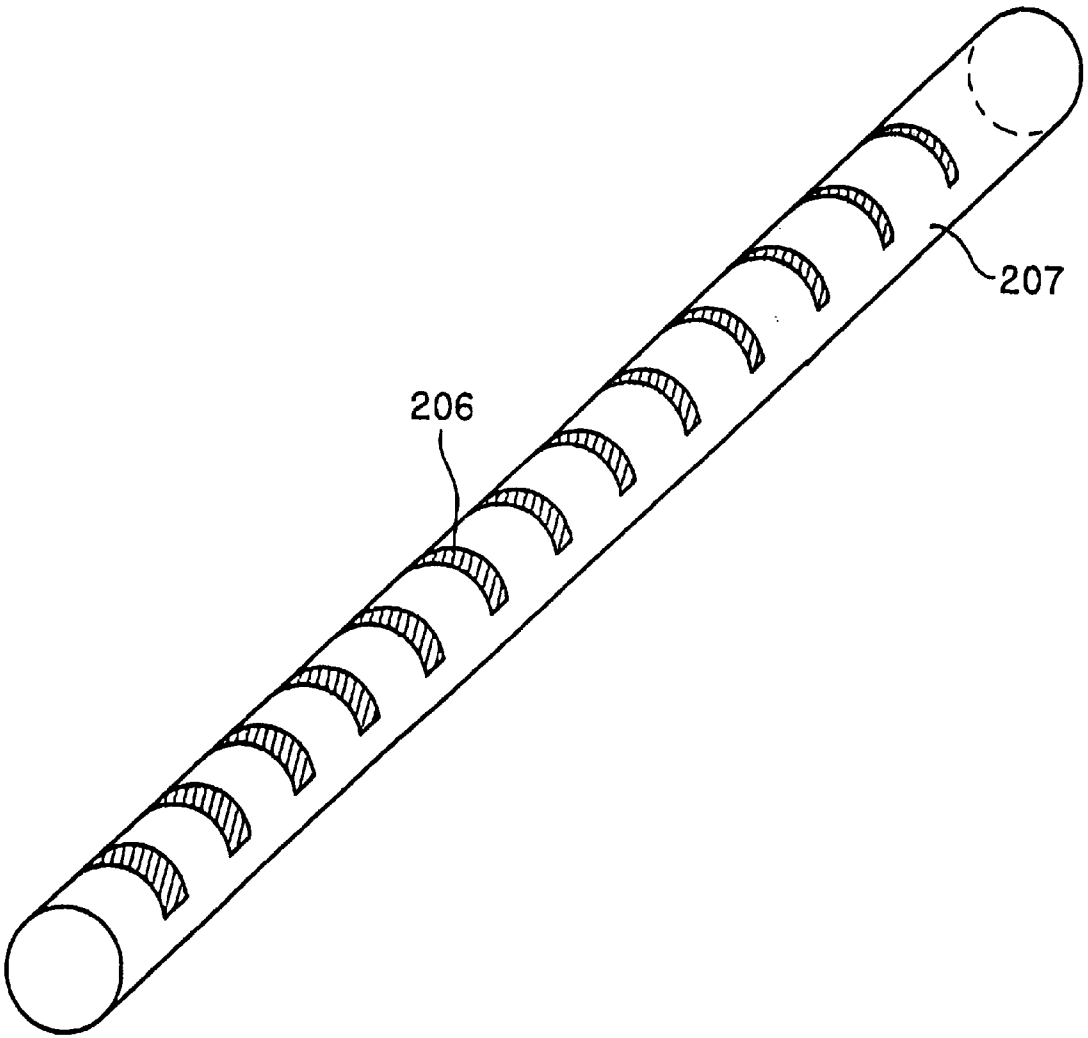
FIG. 11 is a diagram showing a light guide applied to another embodiment of the present invention.
Figure 12:
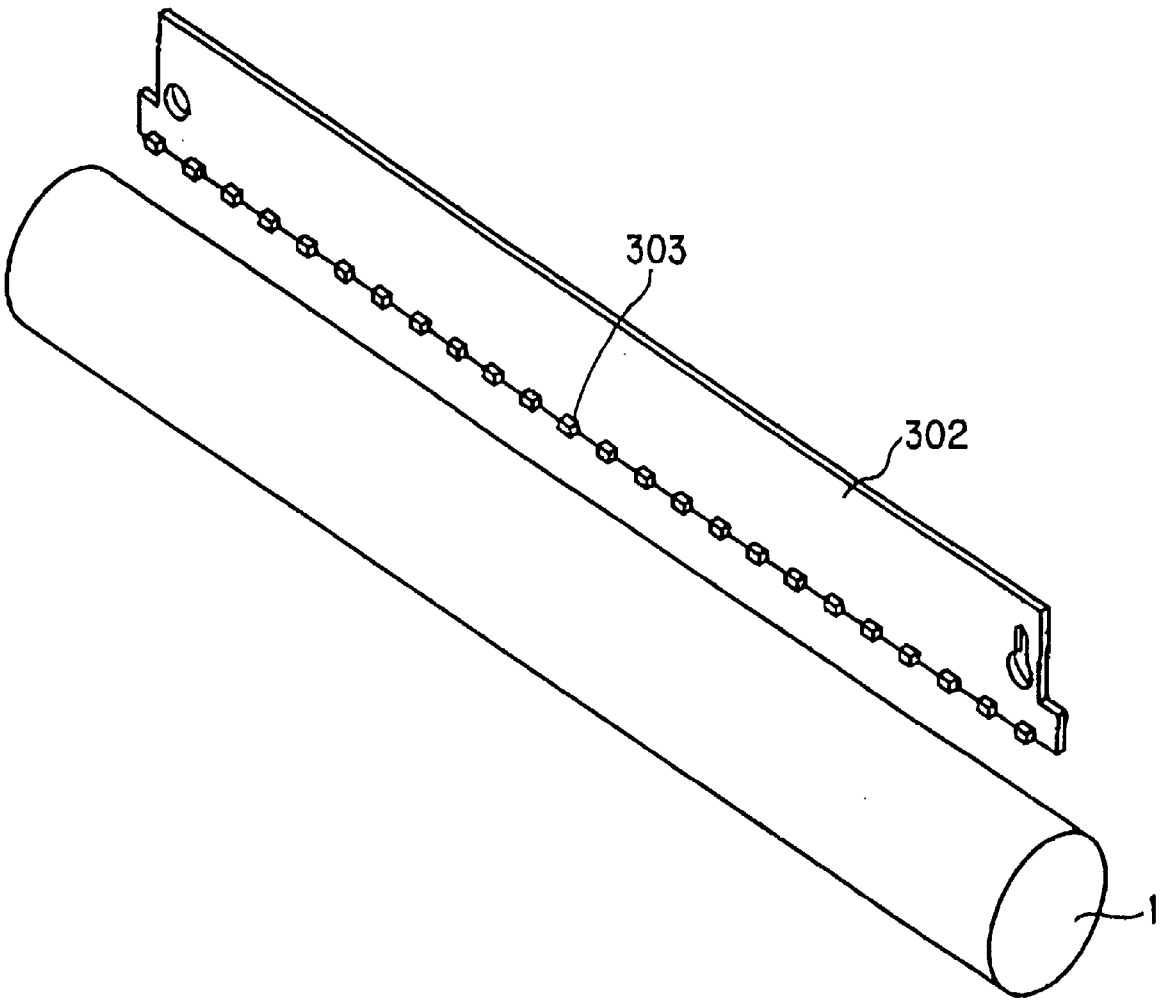
FIG. 12 is a perspective view of a charge removing device applied to a conventional image forming apparatus.

Next, an image forming apparatus in accordance with a second embodiment of the present invention will be described. FIG. 11 shows a light guide according to the second embodiment FIG. 11 is a schematic diagram showing a light guide 207 serving as the light guide means which is a constituent of the present invention, and is provided in the process cartridge detachably attachable to the image forming apparatus of the present invention. Apart from what is described below, the construction of the second embodiment is the same as that of the first embodiment.

In this embodiment, to cause the light from the LED lamp 301 to be reflected to reach the surface of the photosensitive drum 1, a reflection means is provided on the surface of the light guide. This reflection means consists of a plurality of reflection surfaces 206 as reflection films serving as reflecting portions formed of a paint (or resin) of a color of high reflectance (white, silver or the like).

It is desirable for the reflection surfaces 206 not to be light-transmittable.

It is so arranged that the farther the reflection surface 206 is from the LED lamp 301, the larger is the area thereof so that the charge removal light may be applied to the photosensitive drum uniformly with respect to the longitudinal direction thereof.

As compared with the light guide of the first embodiment, the light guide 207 of this embodiment exhibits a relatively low reflection efficiency. However, due to its simple configuration, it makes it possible to form a charge removing device at a low cost.

Instead of providing it in the process cartridge, it is also possible to provide the light guide on the image forming apparatus main body side, with the system configuration of the process cartridge being the same as that of above described embodiments except for the construction of the light guide. In this case, the positional accuracy of the photosensitive drum and the light guide is deteriorated to some degree. On the other hand, it makes it possible to realize a uniform charge removal relatively free from light quantity ripple and to achieve a reduction in the process cartridge cost.

As described above, the process cartridge, which is detachably attachable to the image forming apparatus main body and which has an image bearing member, is provided with a light guide means, such as a light guide, for causing light from a light emission means provided in the image forming apparatus main body to be applied to the surface of the image bearing member, whereby it is possible to produce a charge removing device at low cost and to provide an image forming apparatus and a process cartridge free from image problems, such as lateral stripes in a halftone image or drum positive ghost, without involving an increase in the size of the image forming apparatus main body.

The above-described embodiments of the present invention should not be construed restrictively. All manners of modifications are possible within the technical thought of the present invention.

What is claimed is:

1. An image forming apparatus comprising:

a light source mounted on a main body of said apparatus; and a process cartridge detachably attachable to the main body of said apparatus, wherein said process cartridge has a photosensitive member configured to bear an image and light guide means for guiding light, and wherein said light guide means has a reflection means for reflecting light from said light source toward said photosensitive member.

2. An image forming apparatus according to claim 1, wherein said reflection means has a plurality of reflecting portions.

3. An image forming apparatus according to claim 2, wherein said plurality of reflecting portions differ from each other in configuration according to the distance from a light entry portion of said light guide means.

4. An image forming apparatus according to claim 3, wherein said plurality of reflecting portions increase in size in proportion to the distance from the light entry portion of said light guide means.

5. An image forming apparatus according to claim 2, wherein said reflecting portions comprise protrusions and recesses provided on a surface of said light guide means.

6. An image forming apparatus according to claim 2, wherein said reflecting portions comprise reflection films provided on a surface of said light guide means.

7. An image forming apparatus according to claim 2, wherein said light guide means has an elongated configuration, and wherein said plurality of reflecting portions are arranged side by side in the longitudinal direction of said light guide means.

8. An image forming apparatus according to claim 1, wherein said light guide means is formed of glass, acrylic resin, polycarbonate, or polystyrene.

9. An image forming apparatus according to claim 1, further comprising a cover positioned and configured to cover said light guide means, wherein said cover has a first opening through which light from said light source enters said light guide means and a second opening through which light is applied to said photosensitive member from said light guide means.

10. An image forming apparatus according to claim 9, wherein at least the inner surface of said cover covering said light guide means is white.

11. An image forming apparatus according to claim 1, wherein said light guide means has an elongated configuration, and wherein said light source of the main body of said apparatus is arranged at a position opposed to a longitudinal end of said light guide means.

12. An image forming apparatus according to claim 11, further comprising a plurality of light sources mounted on the main body of said apparatus, and wherein said plurality of light sources are arranged at positions opposed to both longitudinal ends of said light guide means.

13. An image forming apparatus according to claim 1, further comprising charging means for charging said photosensitive member, wherein light from said light guide means is applied to said photosensitive member for exposure prior to charging by said charging means.

14. A process cartridge which is detachably attachable to a main body of an image forming apparatus, comprising:

a photosensitive member; and light guide means for guiding light, wherein said light guide means has reflection means for reflecting light toward said photosensitive member.

15. A process cartridge according to claim 14, wherein said reflection means has a plurality of reflecting portions.

16. A process cartridge according to claim 15, wherein said plurality of reflecting portions differ from each other in configuration according to the distance from a light entry portion of said light guide means.

17. A process cartridge according to claim 16, wherein said plurality of reflecting portions increase in size in proportion to the distance from the light entry portion of said light guide means.

18. A process cartridge according to claim 15, wherein said reflecting portions comprise protrusions and recesses provided on a surface of said light guide means.

19. A process cartridge according to claim 15, wherein said reflecting portions comprise reflection films provided on a surface of said light guide means.

20. A process cartridge according to claim 19, wherein said light guide means has an elongated configuration, and wherein said plurality of reflecting portions are arranged side by side in the longitudinal direction of said light guide means.

21. A process cartridge according to claim 14, wherein said light guide means is formed of glass, acrylic resin, polycarbonate, or polystyrene.

22. A process cartridge according to claim 14, further comprising a cover configured and positioned to cover said light guide means, wherein said cover has a first opening through which light enters said light guide means and a second opening through which light is applied to said photosensitive member from said light guide means.

23. A process cartridge according to claim 22, wherein at least the inner surface of said cover covering said light guide means is white.

24. A process cartridge according to claim 14, further comprising charging means for charging said photosensitive member, wherein light from said light guide means is applied to said photosensitive member for exposure prior to charging by said charging means.

25. An image forming apparatus comprising:

a light source mounted on a main body of said apparatus; and a process cartridge detachably attachable to the main body of said apparatus, wherein said process cartridge has a rotatable photosensitive member and light guide means for guiding light, and wherein said light guide means changes the direction of light from said light source to said photosensitive member.

26. An image forming apparatus according to claim 25, wherein said light guide means guides light in the axial direction of said photosensitive member from said light source to said photosensitive member.

27. An image forming apparatus according to claim 25, wherein said light source is provided in the main body of said apparatus at a position outside said process cartridge in the axial direction of said photosensitive member.

28. An image forming apparatus according to claim 27, wherein said process cartridge is attached and detached in a direction substantially perpendicular to the axial direction of said photosensitive member.

29. An image forming apparatus according to claim 25, further comprising a plurality of light sources of the main body of said apparatus, and wherein said plurality of light sources are arranged at positions opposed to both longitudinal ends of said light guide means.

30. An image forming apparatus according to claim 25, wherein the longitudinal direction of said light guide means is substantially the same as the axial direction of said photosensitive member.

31. An image forming apparatus according to claim 25, wherein said light guide means is formed of glass, acrylic resin, polycarbonate, or polystyrene.

32. An image forming apparatus according to claim 25, further comprising a cover configured and positioned to cover said light guide means, wherein said cover has a first opening through which light from said light source enters said light guide means and a second opening through which light is applied from said light guide means to said photosensitive member.

33. An image forming apparatus according to claim 32, wherein at least the inner surface of said cover covering said light guide means is white.

34. An image forming apparatus according to claim 25, wherein said light guide means has reflection means for reflecting light from said light source toward said photosensitive member.

35. An image forming apparatus according to claim 34, wherein said reflection means has a plurality of reflecting portions which increase in size in proportion to the distance from a light entry portion of said light guide means.

36. An image forming apparatus according to claim 35, wherein said reflecting portions comprise protrusions and recesses provided on a surface of said light guide means.

37. An image forming apparatus according to claim 35, wherein said reflecting portions comprise reflection films provided on a surface of said light guide means.

38. An image forming apparatus according to claim 35, wherein said light guide means has an elongated configuration, and wherein said plurality of reflecting portions are arranged side by side in the longitudinal direction of said light guide means.

39. An image forming apparatus according to claim 25, further comprising charging means for charging said photosensitive member, wherein light from said light guide means is applied to said photosensitive member for exposure prior to charging by said charging means.

40. A process cartridge which is detachably attachable to a main body of an image forming apparatus, comprising:

a photosensitive member configured to bear an image; and light guide means for guiding light, wherein said light guide means changes the direction of light from a light source mounted to the main body of the apparatus to said photosensitive member.

41. A process cartridge according to claim 40, wherein said light guide means guides light in the axial direction of said photosensitive member from the light source to said photosensitive member.

42. A process cartridge according to claim 40, wherein said light guide means has an elongated configuration, and wherein the longitudinal direction of said light guide means is substantially the same as the axial direction of said photosensitive member.

43. A process cartridge according to claim 40, wherein said light guide means is formed of glass, acrylic resin, polycarbonate, or polystyrene.

44. A process cartridge according to claim 40, further comprising a cover configured and positioned to cover said light guide means, wherein said cover has a first opening through which light enters said light guide means and a second opening through which light is applied from said light guide means to said photosensitive member.

45. A process cartridge according to claim 44, wherein at least the inner surface of said cover covering said light guide means is white.

46. A process cartridge according to claim 40, wherein said light guide means has reflection means for reflecting light toward said photosensitive member.

47. A process cartridge according to claim 46, wherein said reflection means has a plurality of reflecting portions which increase in size in proportion to the distance from a light entry portion of said light guide means.

48. A process cartridge according to claim 47, wherein said reflecting portions comprise protrusions and recesses provided on a surface of said light guide means.

49. A process cartridge according to claim 47, wherein said reflecting portions comprise reflection films provided on a surface of said light guide means.

50. A process cartridge according to claim 47, wherein said light guide means has an elongated configuration, and wherein said plurality of reflecting portions are arranged side by side in the longitudinal direction of said light guide means.

51. A process cartridge according to claim 40, further comprising charging means for charging said photosensitive member, wherein light from said light guide means is applied to said photosensitive member for exposure prior to charging by said charging means.

* * * * *

UNITED STATES PATENT AND TRADEMARK OFFICE

CERTIFICATE OF CORRECTION

PATENT NO. : 6,738,588 B2
DATED : May 18, 2004
INVENTOR(S) : Kanji Yokomori et al.

It is certified that error appears in the above-identified patent and that said Letters Patent is hereby corrected as shown below:

Column 11,
Line 22, “and wherein” should read -- wherein --.
Line 51, “claim 19” should read -- claim 15 --.

Column 12,
Line 31, “and wherein” should read -- wherein --.

Signed and Sealed this

Sixteenth Day of November, 2004

JON W. DUDAS
*Director of the United States Patent and Trademark Office*